US011067924B2

(12) United States Patent
Adachi et al.

(10) Patent No.: US 11,067,924 B2
(45) Date of Patent: Jul. 20, 2021

(54) HEATING DEVICE, FIXING DEVICE, AND IMAGE FORMING APPARATUS

(71) Applicants: Tomoya Adachi, Kanagawa (JP); Yuusuke Furuichi, Kanagawa (JP)

(72) Inventors: Tomoya Adachi, Kanagawa (JP); Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/212,817

(22) Filed: Dec. 7, 2018

(65) Prior Publication Data

US 2019/0179242 A1 Jun. 13, 2019

(30) Foreign Application Priority Data

Dec. 8, 2017 (JP) ..... JP2017-236431
Nov. 30, 2018 (JP) ..... JP2018-225168

(51) Int. Cl.
*G03G 15/20* (2006.01)
*G03G 15/00* (2006.01)

(52) U.S. Cl.
CPC ..... *G03G 15/2039* (2013.01); *G03G 15/2042* (2013.01); *G03G 15/2053* (2013.01);
(Continued)

(58) Field of Classification Search
CPC ..... G03G 15/2017; G03G 15/2039; G03G 15/2042; G03G 15/2053; G03G 2215/2003
See application file for complete search history.

(56) References Cited

U.S. PATENT DOCUMENTS 9,864,312 B1 * 1/2018 Okano ..... G03G 15/2039
2009/0202266 A1 * 8/2009 Kurata ..... G03G 15/2042 399/69

(Continued)

FOREIGN PATENT DOCUMENTS

EP 2711778 3/2014
JP 2015-028531 2/2015

(Continued)

OTHER PUBLICATIONS

Extended European Search Report dated May 10, 2019.

*Primary Examiner* — Thomas S Giampaolo, II
(74) *Attorney, Agent, or Firm* — Harness, Dickey & Pierce, P.L.C.

(57) ABSTRACT

A heating device includes a base, a plurality of resistance heating elements, a power control circuit, a first temperature sensor, a second temperature sensor, and control circuitry. The resistance heating elements is disposed in a longitudinal direction of the base and electrically connected in parallel with each other. The power control circuit is configured to supply electrical power to the resistance heating elements. The control circuitry is configured to control an electrical power amount of the power control circuit so that temperatures of the resistance heating elements become equal to a first predetermined temperature based on a result of sensing with a first temperature sensor of the resistance heating elements and cut off the electrical power supplied from the power control circuit to the resistance heating elements in response to sensing of a second predetermined temperature with a second temperature sensor of the resistance heating elements.

38 Claims, 8 Drawing Sheets

(52) U.S. Cl.
CPC ..... *G03G 15/80* (2013.01); *G03G 2215/2019* (2013.01); *G03G 2215/2035* (2013.01)

(56) References Cited

U.S. PATENT DOCUMENTS

| | | | | |
|---|---|---|---|---|
| 2009/0245900 | A1 | 10/2009 | Kagawa | |
| 2013/0011157 | A1* | 1/2013 | Kaino | G03G 15/2017 399/92 |
| 2013/0330103 | A1 | 12/2013 | Takahashi | |
| 2014/0076878 | A1* | 3/2014 | Shimura | G03G 15/2042 219/216 |
| 2014/0212159 | A1* | 7/2014 | Koda | G03G 15/2039 399/69 |
| 2016/0011551 | A1 | 1/2016 | Nakayama | |
| 2017/0075268 | A1* | 3/2017 | Ogura | G03G 15/2053 |
| 2017/0102650 | A1 | 4/2017 | Shimura et al. | |
| 2017/0205742 | A1* | 7/2017 | Shoji | G03G 15/2039 |

FOREIGN PATENT DOCUMENTS

| | | |
|---|---|---|
| JP | 2015-194713 | 11/2015 |
| JP | 2015-227917 | 12/2015 |
| JP | 2016-018127 | 2/2016 |
| JP | 2016-153859 | 8/2016 |

* cited by examiner

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application Nos. 2017-236431, filed on Dec. 8, 2017, and 2018-225168, filed on Nov. 30, 2018, in the Japan Patent Office, the entire disclosure of each of which is incorporated by reference herein.

BACKGROUND

Technical Field

Aspects of the present disclosure relate to a heating device, a fixing device, and an image forming apparatus each including a plurality of resistance heating elements.

Description of the Related Art

Various types of fixing devices used in an electrophotographic image forming apparatus are known. In one type of fixing devices, a thin fixing belt having a low heat capacity is heated by a planar heating body including a base and a resistance heating element.

SUMMARY

In an aspect of the present disclosure, there is provided a heating device that includes a base, a plurality of resistance heating elements, a power control circuit, a first temperature sensor, a second temperature sensor, and control circuitry. The plurality of resistance heating elements is disposed in a longitudinal direction of the base and electrically connected in parallel with each other. The power control circuit is configured to supply electrical power to the plurality of resistance heating elements. The first temperature sensor is configured to sense a temperature of a first resistance heating element of the plurality of resistance heating elements. The second temperature sensor is configured to sense a temperature of a second resistance heating element of the plurality of resistance heating elements. The control circuitry is configured to control an electrical power amount of the power control circuit so that temperatures of the plurality of resistance heating elements become equal to a first predetermined temperature based on a result of sensing with the first temperature sensor and cut off the electrical power supplied from the power control circuit to the plurality of resistance heating elements in response to sensing of a second predetermined temperature with the second temperature sensor.

In another aspect of the present disclosure, there is provided a fixing device that includes a pressing rotator, a nip former, a belt member, and the heating device. The nip former is configured to form a fixing nip between the nip former and the pressing rotator to fix a developer on a recording medium passing through the fixing nip. The belt member has a tubular shape. The heating device is configured to heat the belt member and transfer heat of the belt member to the fixing nip.

In still another aspect of the present disclosure, there is provided an image forming apparatus that includes an image forming device, a recording-medium feeder, and the fixing device. The image forming device is configured to form the image with the developer. The recording-medium feeder is configured to feed the recording medium to the image forming device. The fixing device is configured to fix the image on the recording medium.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1A:
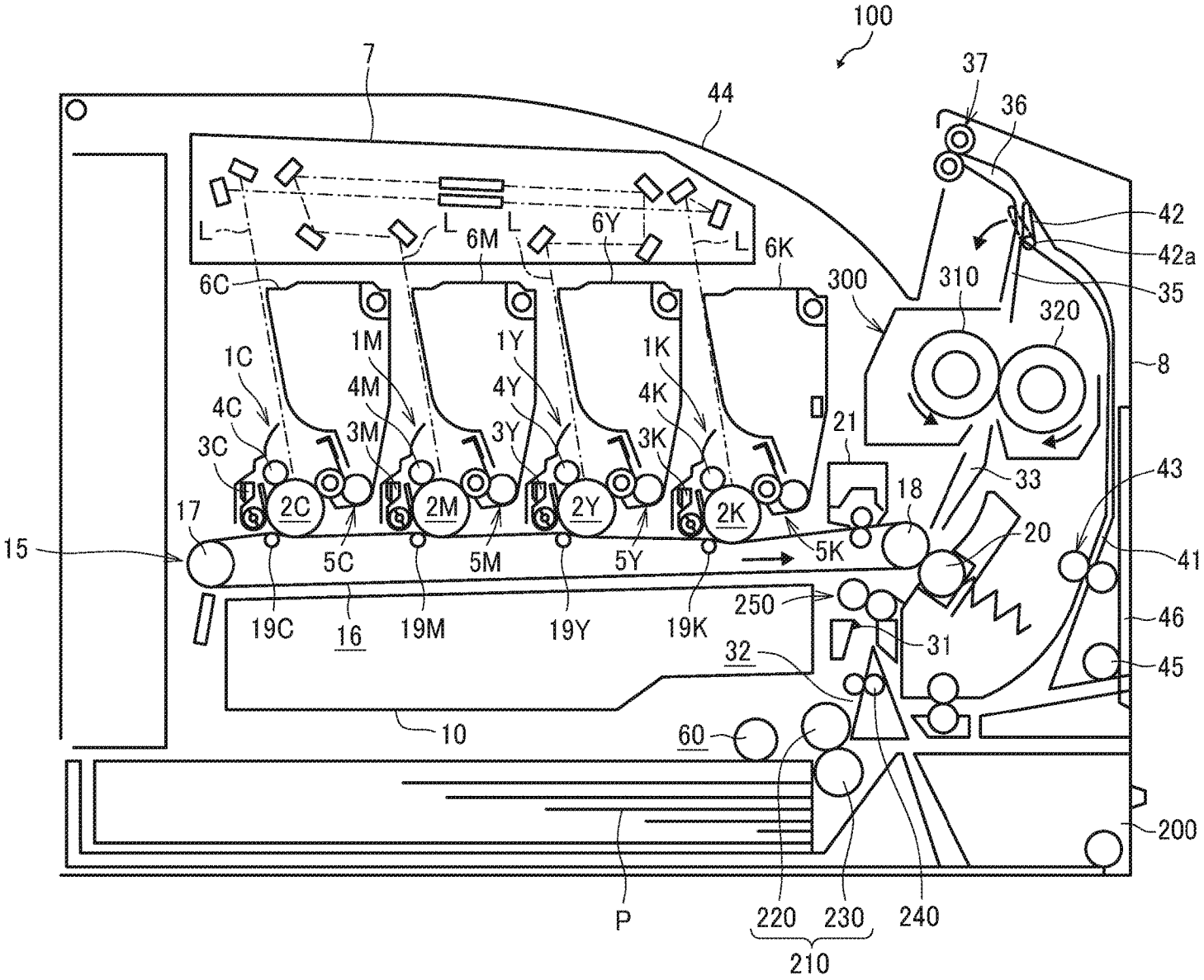
FIG. 1A is a schematic configuration diagram of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENT OF THE DISCLOSURE

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

The following describes a heating device according to an embodiment of the present disclosure, and a fixing device and an image forming apparatus (laser printer) each including the heating device with reference to the accompanying drawings. In the drawings, parts identical or equivalent to each other are denoted by an identical reference sign, and any duplicate description will be simplified or omitted as appropriate. In description of each component, for example, the dimension, material, shape, and relative disposition of the component are merely exemplary and not intended to limit the scope of the present disclosure unless otherwise described specifically.

In the embodiment below, the description will be made on a "sheet" as a "recording medium", but the "recording medium" is not limited to paper (sheet). The "recording medium" includes not only paper (sheet) but also an overhead projector (OHP) sheet, a cloth, a metal sheet, a plastic film, or a prepreg sheet of carbon fiber impregnated with resin in advance.

The "recording medium" also includes media to which developer and ink can adhere, and those referred to as record paper and a record sheet. Examples of the "sheet" include, in addition to standard paper, a cardboard, a card, an envelope, thin paper, coated paper (such as art paper), and tracing paper.

"Image formation" in the following description means not only provision of an image having meaning, such as a character or a figure, to a medium but also provision of an image having no meaning, such as a pattern, to a medium.

Configuration of Laser Printer

Figure 1B:
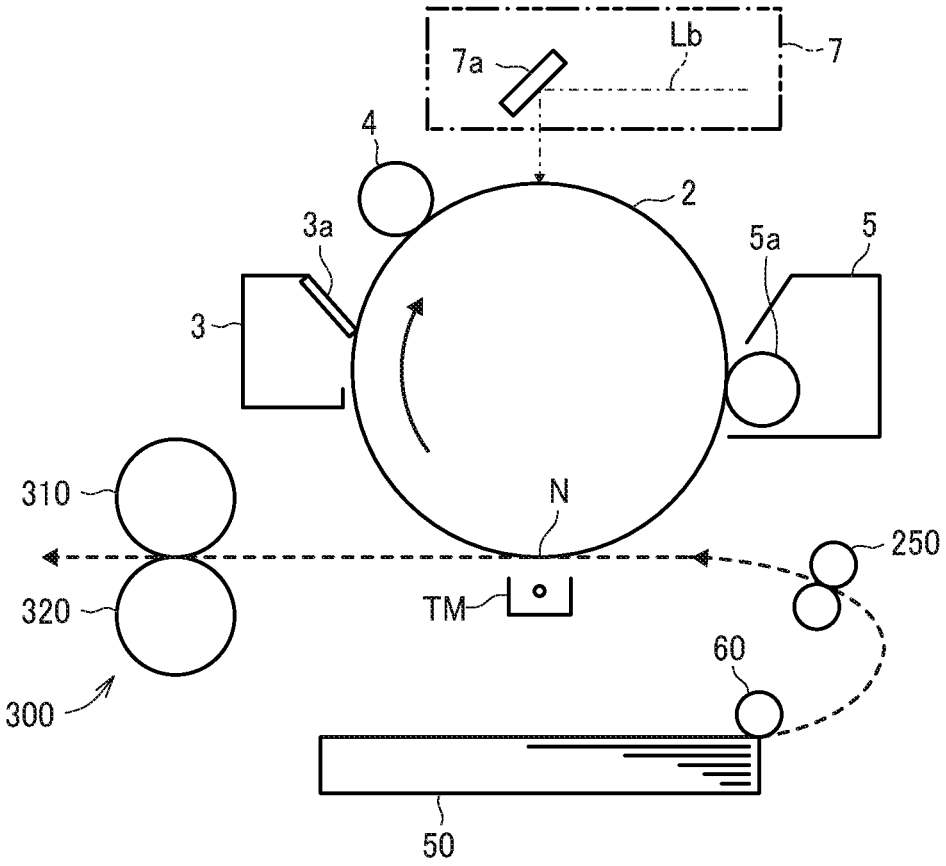
FIG. 1B is a principle diagram of the image forming apparatus according to the embodiment of the present disclosure.

FIG. 1A is a configuration diagram schematically illustrating the configuration of a color laser printer 100 as an image forming apparatus including a heating device according to an embodiment of the present disclosure or a fixing device 300. FIG. 1B illustrates the principle of the laser printer 100 in a simplified manner.

The color laser printer 100 includes four process units 1K, 1Y, 1M, and 1C as an image forming device. These process units form an image by using developers of black (K), yellow (Y), magenta (M), and cyan (C) corresponding to separated color components of a color image.

The process units 1K, 1Y, 1M, and 1C have identical configurations except for toner bottles 6K, 6Y, 6M, and 6C housing unused toners of colors different from each other. Thus, the following description will be made on the configuration of the process unit 1K, and omit description of the other process units 1Y, 1M, and 1C.

The process unit 1K includes an image bearer 2K (for example, a photoconductor drum), a drum cleaning device 3K, and a neutralization device. The process unit 1K further includes, for example, a charging device 4K as a charging unit that uniformly charges the surface of the image bearer, and a developing device 5K as a developing unit that performs visible image processing of an electrostatic latent image formed on the image bearer. The process unit 1K is detachably mounted on the body of the laser printer 100 to allow simultaneous replacement of an expendable component.

An exposure device 7 is disposed above the process units 1K, 1Y, 1M, and 1C installed on the laser printer 100. The exposure device 7 reflects a laser beam Lb from a laser diode at a mirror 7*a* to irradiate the image bearer 2K with the laser beam based on writing scanning in accordance with image information, in other words, image data.

A transfer device 15 is disposed below the process units 1K, 1Y, 1M, and 1C in the present embodiment. The transfer device 15 corresponds to a transfer unit TM illustrated in FIG. 1B. Primary transfer rollers 19K, 19Y, 19M, and 19C are disposed in contact with an intermediate transfer belt 16, facing to the image bearers 2K, 2Y, 2M, and 2C.

The intermediate transfer belt 16 circularly travels while being suspended on the primary transfer rollers 19K, 19Y, 19M, and 19C, a driving roller 18, and a driven roller 17. A secondary transfer roller 20 is disposed in contact with the intermediate transfer belt 16, facing to the driving roller 18. When the image bearers 2K, 2Y, 2M, and 2C are first image bearers of the respective colors, the intermediate transfer belt 16 is a second image bearer obtained by synthesizing the images.

A belt cleaning device 21 is installed downstream of the secondary transfer roller 20 in the travel direction of the intermediate transfer belt 16. A cleaning backup roller is installed on a side opposite to the belt cleaning device 21 with respect to the intermediate transfer belt 16.

A sheet feeding device 200 including a tray loaded with sheets P is installed below the laser printer 100. The sheet feeding device 200 serves as a recording-medium feeder. The sheet feeding device 200 can house a bundle of multiple sheets P as recording media, and is integrated with a sheet feeding roller 60 and a pair of rollers 210 as a conveyance unit of the sheets P. The sheet feeding device 200 is detachable from the body of the laser printer 100 to, for example, refill sheets. The sheet feeding roller 60 and the pair of rollers 210 are disposed above the sheet feeding device 200 to convey the topmost sheet P in the sheet feeding device 200 toward a sheet feed path 32.

A pair of registration rollers 250 as a separated conveyance unit are disposed at a closest position upstream of the secondary transfer roller 20 in the conveyance direction to temporarily stop a sheet P fed from the sheet feeding device 200. This temporary stopping forms slack on the leading end side of the sheet P, thereby correcting incline (skew) of the sheet P.

A registration sensor 31 is disposed at a closest position upstream of the pair of registration rollers 250 in the conveyance direction to sense passing of a leading end portion of the sheet. When a predetermined time elapses since the registration sensor 31 has sensed passing of the leading end portion of the sheet, the sheet temporarily stops in contact with the pair of registration rollers 250.

A conveyance roller 240 is disposed at a downstream end of the sheet feeding device 200 to convey upward a sheet conveyed rightward from the pair of rollers 210. As illustrated in FIG. 1A, the conveyance roller 240 conveys the sheet toward the pair of registration rollers 250 above.

The pair of rollers 210 are a pair of upper and lower rollers. The pair of rollers 210 may be of an FRR separation scheme or an FR separation scheme. In the FRR separation scheme, a separation roller (return roller) to which a certain amount of torque is applied in a revered sheet feeding direction by a drive shaft through a torque limiter is pressed against a feed roller to separate sheets by a nip between the rollers. In the FR separation scheme, a separation roller (friction roller) supported by a fixed shaft through a torque limiter is pressed against a feed roller to separate sheets by a nip between the rollers.

In the present embodiment, the pair of rollers 210 are of the FRR separation scheme. Specifically, the pair of rollers 210 include an upper feed roller 220 to convey a sheet into the machine, and a lower separation roller 230 to which drive power is applied in a direction opposite to a drive direction of the feed roller 220 by a drive shaft through a torque limiter.

The separation roller 230 is pressed toward the feed roller 220 by a pressing unit such as a spring. The sheet feeding roller 60 rotates leftward in FIG. 1A by drive power of the feed roller 220 transferred through a clutch.

A sheet P made contact with the pair of registration rollers 250 and having slack formed at the leading end portion is fed out to a secondary transfer nip (in FIG. 1B, a transfer nip N) between the secondary transfer roller 20 and the driving roller 18 at a timing when a toner image formed on the intermediate transfer belt 16 is excellently transferred. Then, a toner image formed on the intermediate transfer belt 16 is highly accurately transferred to a desired transfer position on the sheet P thus fed out in an electrostatic manner due to bias applied at the secondary transfer nip.

A post-transfer conveyance path 33 is disposed above the secondary transfer nip between the secondary transfer roller 20 and the driving roller 18. The fixing device 300 is installed near an upper end of the post-transfer conveyance path 33. The fixing device 300 includes a fixing belt 310 enclosing a heating device 3000, and a pressing roller 320 as a pressing member that rotates while contacting with the fixing belt 310 at a predetermined pressure. The fixing device 300 may have other configurations as illustrated in FIGS. 2B to 2D to be described later.

A post-fixing conveyance path 35 is disposed above the fixing device 300 and bifurcated into a sheet ejection path 36 and a reverse conveyance path 41 at an upper end of the post-fixing conveyance path 35. A switching member 42 is disposed at this bifurcation point and swings about a pivot shaft 42*a*. A pair of ejection rollers 37 are disposed near an opening end of the sheet ejection path 36.

The reverse conveyance path 41 joins a sheet feed path 32 at the other end on a side opposite to the bifurcation point. A pair of reverse conveyance rollers 43 are disposed halfway through the reverse conveyance path 41. An ejection tray 44 has a shape concave inward of the laser printer 100 and is installed at an upper portion of the laser printer 100.

A powder container 10 (for example, a toner container) is disposed between the transfer device 15 and the sheet feeding device 200. The powder container 10 is detachably mounted on the body of the laser printer 100.

The laser printer 100 according to the present embodiment needs a predetermined distance between the sheet feeding roller 60 and the secondary transfer roller 20 to achieve transfer sheet conveyance. The powder container 10 is installed in a dead space along the distance, thereby downsizing the entire laser printer.

A transfer cover 8 is installed above the sheet feeding device 200 on a front side in a direction in which the sheet feeding device 200 is drawn. The transfer cover 8 is opened to allow inspection inside the laser printer 100. The transfer cover 8 is provided with a manual sheet feeding roller 45 and a manual sheet feeding tray 46.

The laser printer according to the present embodiment is an exemplary image forming apparatus, and the image forming apparatus is not limited to a laser printer. Specifically, the image forming apparatus may be any one of a copier, a facsimile, a printer, a printing machine, and an inkjet record device, or may be a multifunction peripheral as a combination of at least two of these devices.

Operation of Laser Printer

The following describes a basic operation of the laser printer according to the present embodiment with reference to FIG. 1A. The description is first made on a case in which single-side printing is performed. As illustrated in FIG. 1A, the sheet feeding roller 60 rotates in response to a sheet feeding signal from a controller of the laser printer 100. Then, the sheet feeding roller 60 separates the topmost sheet in a bundle of sheets P loaded on the sheet feeding device 200 and feeds the sheet to the sheet feed path 32.

Having been fed out by the sheet feeding roller 60 and the pair of rollers 210, this sheet P forms slack when the leading end of the sheet reaches a nip between the pair of registration rollers 250 and waits in this state. Then, skew of the leading end of the sheet P is corrected while waiting for an optimum timing (synchronization) for transferring a toner image formed on the intermediate transfer belt 16 onto the sheet P.

In a case of manual sheet feeding, the topmost sheet in a bundle of sheets loaded on the manual sheet feeding tray 46 is conveyed to the nip between the pair of registration rollers 250 through part of the reverse conveyance path 41 by the manual sheet feeding roller 45. The subsequent operation is identical to the operation in the case of sheet feeding from the sheet feeding device 200.

Description of an image formation operation is made with the process unit 1K, whereas description of the other process units 1Y, 1M, and 1C is omitted. First, the charging device 4K uniformly charges the surface of the image bearer 2K to high potential. Then, the exposure device 7 irradiates the surface of the image bearer 2K with the laser beam Lb based on image data.

When the surface of the image bearer 2K is irradiated with the laser beam Lb, the potential is reduced at an irradiated part of the surface of the image bearer 2K to form an electrostatic latent image. The developing device 5K includes a developer bearer bearing developer containing toner, and transitions unused black toner supplied from the toner bottle 6K, through the developer bearer, to the surface of the image bearer 2K on which the electrostatic latent image has been formed. The image bearer 2K, to which the toner is transitioned, forms (develops) a black toner image on the surface of the image bearer. Then, the toner image formed on the image bearer 2K is transferred onto the intermediate transfer belt 16.

The drum cleaning device 3K removes residual toner adhering to the surface of the image bearer 2K subjected to an intermediate transfer process. The removed residual toner is transferred to and collected in a waster toner housing in the process unit 1K by a waster toner conveyance unit. The neutralization device eliminates residual electric charge of the image bearer 2K from which the residual toner has been removed by the drum cleaning device 3K.

Similarly for the process units 1Y, 1M, and 1C of the other colors, toner images are formed on the image bearers 2Y, 2M, and 2C and transferred onto the intermediate transfer belt 16 so that the toner images are superimposed with each other.

The intermediate transfer belt 16 onto which toner images are transferred in a superimposing manner travels to the secondary transfer nip between the secondary transfer roller 20 and the driving roller 18. The pair of registration rollers 250 nip and rotate a sheet in contact with the pair of registration rollers 250 at a predetermined timing, and convey the sheet to the secondary transfer nip of the secondary transfer roller 20 in accordance with a timing at which the toner images formed on the intermediate transfer belt 16 by superimposition transfer are excellently transferred. In this manner, the toner images on the intermediate transfer belt 16 are transferred onto the sheet P fed out by the pair of registration rollers 250.

The sheet P onto which the toner images are transferred is conveyed to the fixing device 300 through the post-transfer conveyance path 33. Having been conveyed to the fixing device 300, the sheet P is sandwiched between the fixing belt 310 and the pressing roller 320, and heated and pressurized to fix the unfixed toner images to the sheet P. The sheet P to which the toner images are fixed is fed out from the fixing device 300 to the post-fixing conveyance path 35.

At a timing when the sheet P is fed out from the fixing device 300, the switching member 42 is at a position at which the vicinity of the upper end of the post-fixing conveyance path 35 is opened as illustrated with a solid line in FIG. 1A. The sheet P fed out from the fixing device 300 is fed out to the sheet ejection path 36 through the post-fixing conveyance path 35. The pair of ejection rollers 37 nip the sheet P fed out to the sheet ejection path 36 and rotate to discharge the sheet P to the ejection tray 44, which ends the single-side printing.

The following describes a case in which duplex printing is performed. Similarly to the case of single-side printing, the fixing device 300 feeds a sheet P to the sheet ejection path 36. Then, when duplex printing is performed, the pair of ejection rollers 37 rotate to convey part of the sheet P out of the laser printer 100.

Then, when the rear end of the sheet P passes through the sheet ejection path 36, the switching member 42 swings about the pivot shaft 42*a* as illustrated with a dotted line in FIG. 1A to close the upper end of the post-fixing conveyance path 35. Substantially simultaneously with the closing of the upper end of the post-fixing conveyance path 35, the pair of ejection rollers 37 rotate in a direction opposite to a direction in which the sheet P is conveyed out of the laser printer 100, thereby feeding the sheet P to the reverse conveyance path 41.

Having been fed out to the reverse conveyance path 41, the sheet P reaches the pair of registration rollers 250 through the pair of reverse conveyance rollers 43. Then, the pair of registration rollers 250 wait for an optimum timing (synchronization) for transferring toner images formed on the intermediate transfer belt 16 onto a toner-image untransferred surface of the sheet P, before feeding the sheet P to the secondary transfer nip.

Then, the secondary transfer roller 20 and the driving roller 18 transfer the toner images onto the toner-image untransferred surface (back surface) of the sheet P when the sheet P passes through the secondary transfer nip. Then, the sheet P on which the toner images are transferred is conveyed to the fixing device 300 through the post-transfer conveyance path 33.

The fixing device 300 sandwiches the conveyed sheet P between the fixing belt 310 and the pressing roller 320, and heats and pressurizes the sheet P to fix the unfixed toner images to the back surface of the sheet P. The sheet P having front and back surfaces to which toner images are fixed in this manner is fed out from the fixing device 300 to the post-fixing conveyance path 35.

At a timing when the sheet P is fed out from the fixing device 300, the switching member 42 is at a position at which the vicinity of the upper end of the post-fixing conveyance path 35 is opened as illustrated with a solid line in FIG. 1A. Having been fed out from the fixing device 300, the sheet P is then fed out to the sheet ejection path 36 through the post-fixing conveyance path. The pair of ejection rollers 37 nip the sheet P fed out to the sheet ejection path 36 and rotate to discharge the sheet P to the ejection tray 44, which ends the duplex printing.

After toner images on the intermediate transfer belt 16 are transferred onto a sheet P, residual toner adheres on the intermediate transfer belt 16. The belt cleaning device 21 removes the residual toner from the intermediate transfer belt 16. The toner removed from the intermediate transfer belt 16 is conveyed to the powder container 10 by the waster toner conveyance unit and collected in the powder container 10.

Fixing Device

Figure 3A:
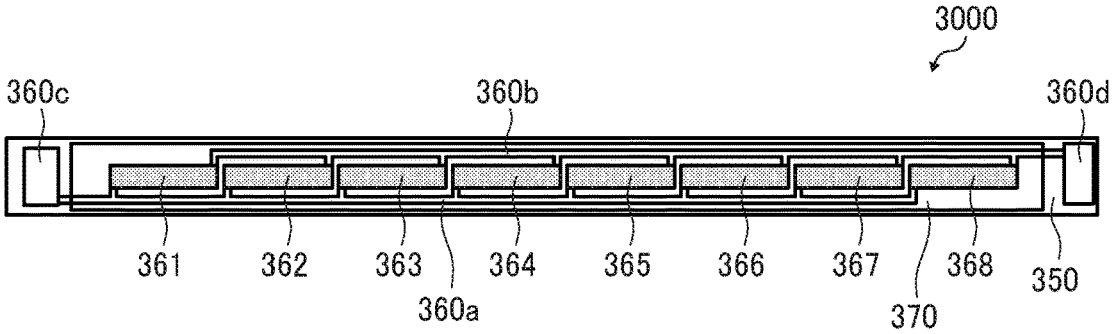
FIGS. 3A to 3C are each a plan view illustrating an array state of resistance heating elements in a planar heat generation body provided with electrodes at both ends.

The following describes a heating device according to the present embodiment and first to fourth fixing devices 300. The heating device 3000 according to the present embodiment heats the fixing belt 310 of the fixing device 300. The heating device 3000 is formed of a planar heating body, and includes a base 350 obtained by covering an elongated metal thin plate member with an insulation material, and a heating member 360 disposed on the base 350 as illustrated in FIGS. 3A and 4.

The heating member 360 includes a plurality of resistance heating elements 361 to 368 disposed straight at an equal interval in the longitudinal direction of the base 350. Power lines 360*a* and 360*b* having low resistance values are disposed straight in parallel to each other on both sides of each of the resistance heating elements 361 to 368 in the transverse direction and connected with both ends of each of the resistance heating elements 361 to 368. A power controller (e.g., an electrical power control circuit 450) is connected with electrodes 360*c* and 360*d* formed at end portions of each of the power lines 360*a* and 360*b* as illustrated in FIG. 4.

The heating device 3000 according to the present embodiment includes a first temperature sensor TH1 and a second temperature sensor TH2 as temperature sensors to sense the temperatures of the resistance heating elements. The temperature sensors TH1 and TH2 may be, for example, thermistors.

Figure 2A:
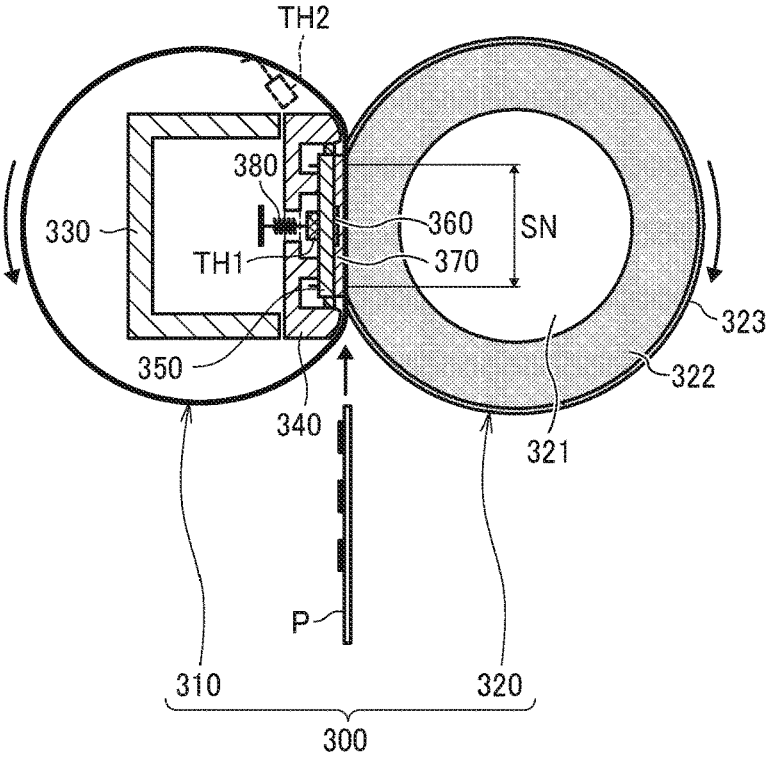
FIG. 2A is a cross-sectional view of a first fixing device according to the embodiment of the present disclosure.
Figure 2B:
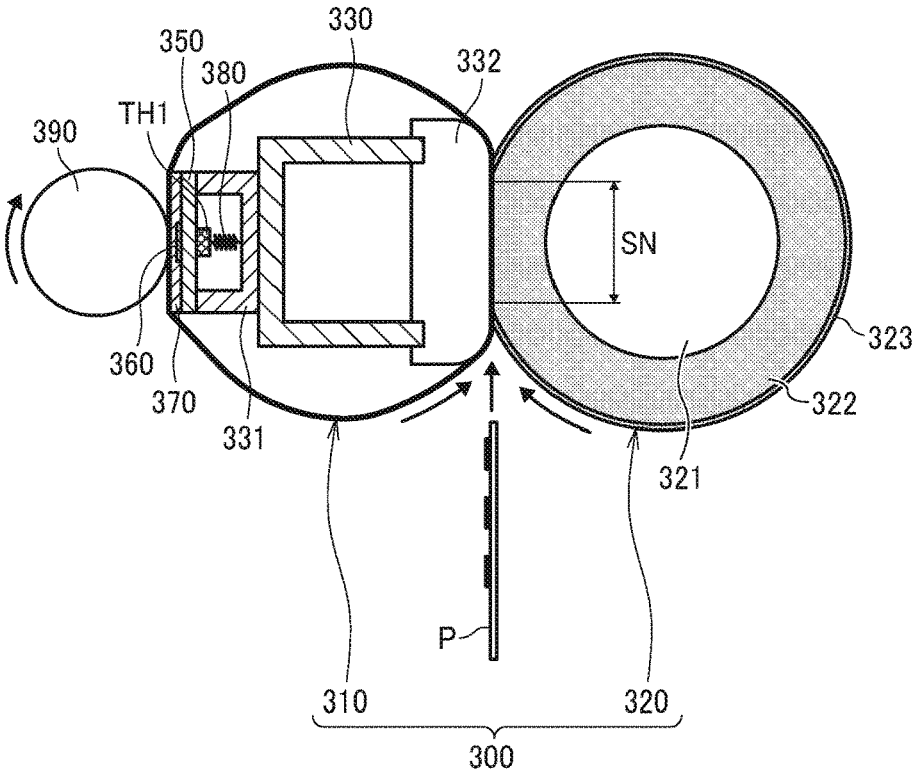
FIG. 2B is a cross-sectional view of a second fixing device according to the embodiment of the present disclosure.
Figure 2C:
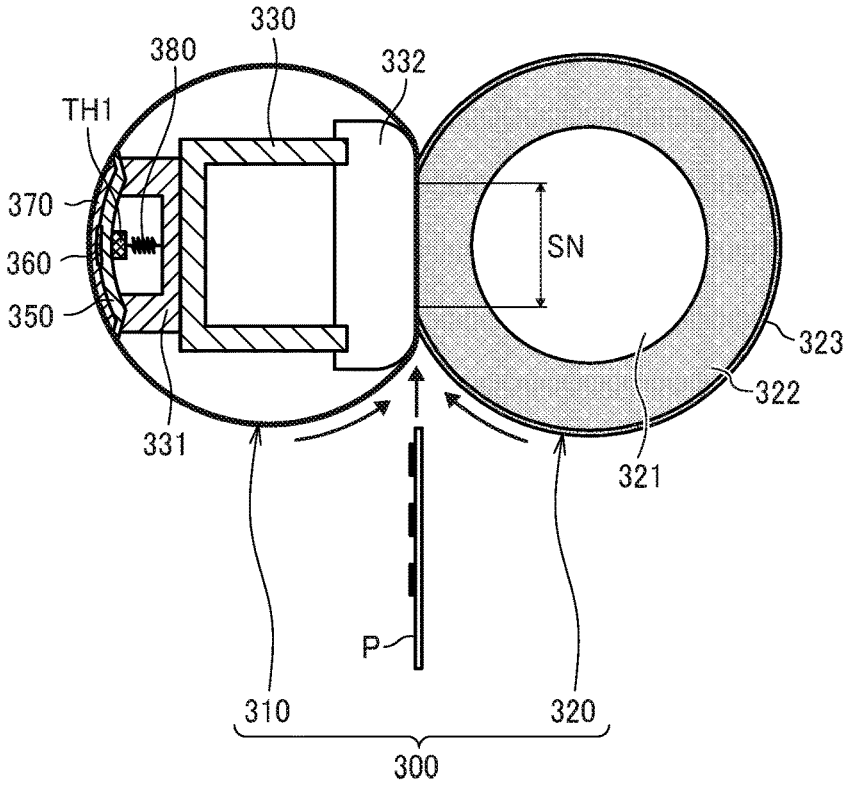
FIG. 2C is a cross-sectional view of a third fixing device according to the embodiment of the present disclosure.
Figure 2D:
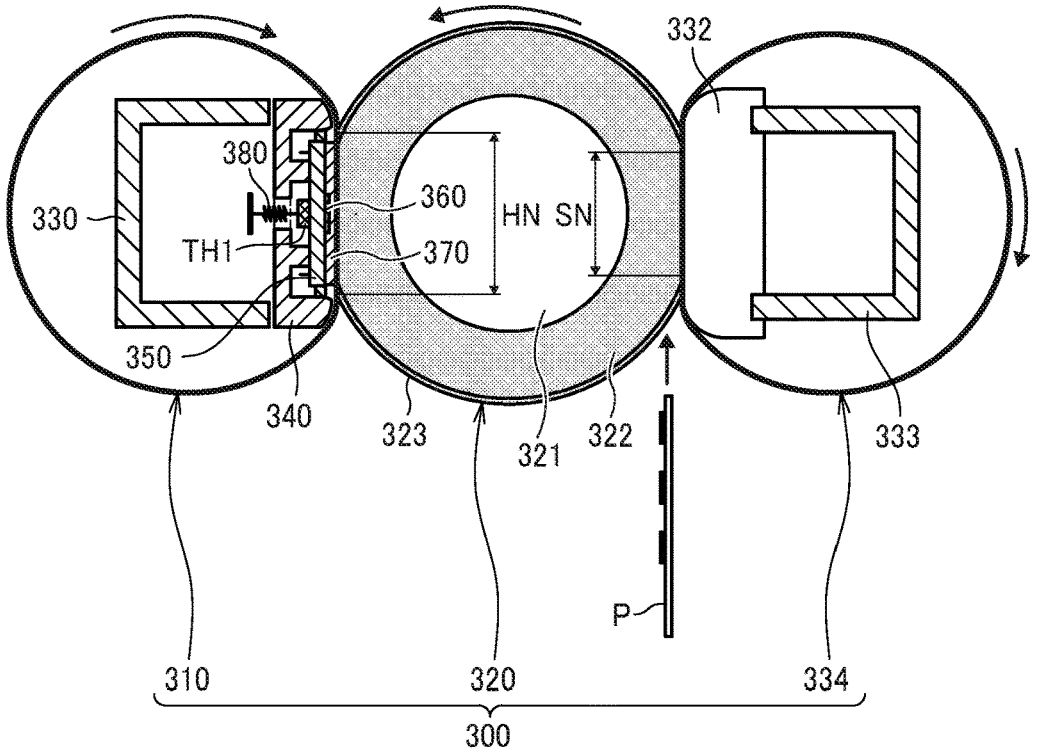
FIG. 2D is a cross-sectional view of a fourth fixing device according to the embodiment of the present disclosure.
Figure 4:
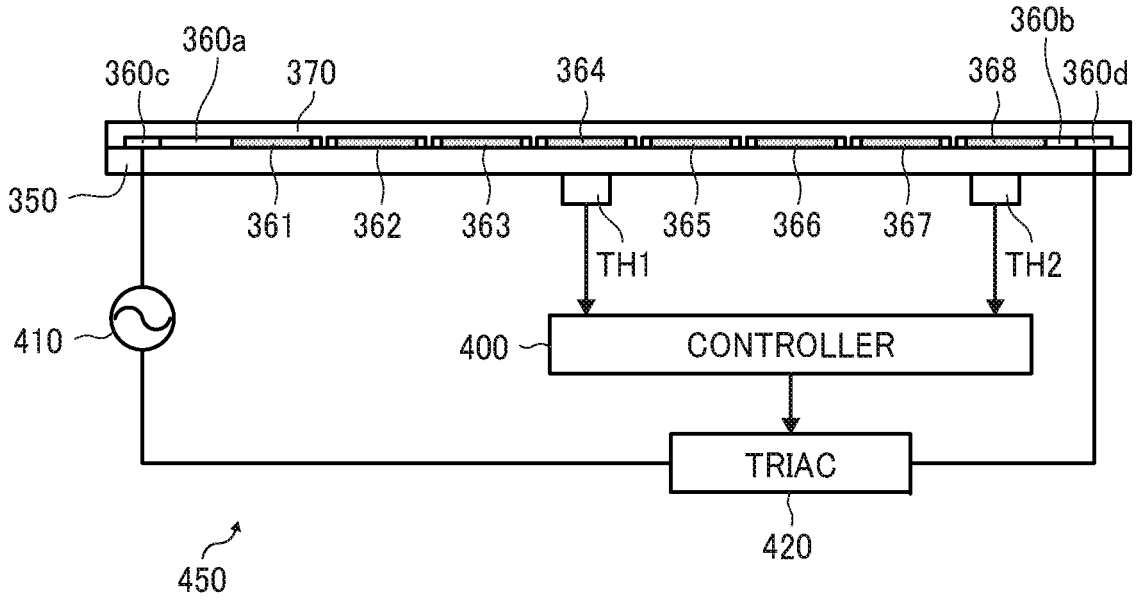
FIG. 4 is a diagram illustrating a heating device, an electrical power control circuit, and a controller.

As illustrated in FIG. 4, the first temperature sensor TH1 and the second temperature sensor TH2 are bonded to the back side of the base 350 by pressing through springs (see spring 380 of FIGS. 2A and 2B). The first temperature sensor TH1 is used to perform temperature control, and the second temperature sensor TH2 is used to secure safety. The two temperature sensors TH1 and TH2 may be each a contact thermistor having a thermal time constant of less than one second.

The first temperature sensor TH1 for temperature control is disposed in the heating region of the resistance heating element 364 (the fourth element from the left) as a first resistance heating element in a central region in the longitudinal direction within a minimum sheet passing width. The second temperature sensor TH2 for securing safety is disposed in the heating region of the resistance heating element 368 (the eighth element from the left) (or the resistance heating element 361 (the first element from the left)) as a second resistance heating element that is an endmost portion in the longitudinal direction.

The two temperature sensors TH1 and TH2 are disposed in the respective regions of the resistance heating elements 364 and 368, avoiding a gap between resistance heating elements where the amount of heat generation decreases. This improves temperature controllability and facilitates breaking sensing when breaking has occurred to any of the resistance heating elements.

The first temperature sensor TH1 may be disposed in the heating region of any of the resistance heating elements 363, 365, and 366. The second temperature sensor TH2 may be disposed at an end region in the longitudinal direction, such as the second resistance heating element 362 or the seventh resistance heating element 367 from the left, and does not necessarily need to be disposed at an endmost portion in the longitudinal direction.

FIG. 4 illustrates, below the heating device 3000, the electrical power control circuit 450 as the power controller to perform power supply (electrical power supply) to the resistance heating elements 361 to 368. The electrical power control circuit includes an alternating-current power source 410 and a triac 420. The alternating-current power source 410 and the triac 420 connect the electrodes 360*c* and 360*d* in series.

Temperatures $T_4$ and $T_8$ sensed by the first temperature sensor TH1 and the second temperature sensor TH2 are input to a controller 400 as a control unit. The controller 400 controls, based on the temperature $T_4$ obtained from the first temperature sensor TH1, the amount of power supply to the electrodes 360*c* and 360*d* through the triac 420 so that the resistance heating elements 361 to 368 each have a predetermined temperature.

The controller 400 may be a micro computer including a central processing unit (CPU), a read-only memory (ROM), a random-access memory (RAM), and an input/output (I/O) interface. When a sheet passes through a fixing nip SN, heat release (heat transfer to the sheet) occurs due to the sheet passing. Thus, the amount of power supply is controlled with the heat release taken into account in addition to the temperature $T_4$ obtained from the first temperature sensor TH1 to control the temperature of the fixing belt 310 to a desired temperature.

As illustrated in FIG. 2A, a first fixing device includes the thin fixing belt 310 having a low heat capacity and the pressing roller 320. The fixing belt 310 includes, for example, a polyimide (PI) tubular base having an outer diameter of 25 mm and a thickness of 40 to 120 μm.

To increase durability and achieve releasability, a release layer made of fluorine-based resin such as p-fluorophenylalanine (PFA) or polytetrafluoroethylene (PTFE) and having a thickness of 5 to 50 μm is formed on the topmost surface layer of the fixing belt 310. An elastic layer made of, for example, rubber and having a thickness of 50 to 500 μm may be provided between the base and the release layer.

The base of the fixing belt 310 is not limited to polyimide but may be thermal resistant resin such as polyetheretherketone (PEEK), or metal base such as nickel (Ni) and stainless use stainless (SUS). Coating with polyimide or PTFE may be provided as a slide layer on an inner peripheral surface of the fixing belt 310.

The pressing roller 320 includes a solid iron cored bar 321 having an outer diameter of, for example, 25 mm, an elastic layer 322 on the surface of the cored bar 321, and a release layer 323 outside the elastic layer 322. The elastic layer 322 is made of silicone rubber and has a thickness of, for example, 3.5 mm. The release layer 323 as a fluorine resin layer having a thickness of, for example, 40 μm approximately is desirably formed on the surface of the elastic layer 322 to increase releasability. The pressing roller 320 is pressed against the fixing belt 310 by a pressing unit.

A stay 330 and a folder 340 are disposed inside the fixing belt 310 in an axis line direction. The stay 330 is made of a metal channel member and has both end portions supported by both side plates of the heating device 3000. The stay 330 reliably receives pressing force by the pressing roller 320 to reliably form the fixing nip SN.

The folder 340 is used to hold the base 350 of the heating device 3000 and supported by the stay 330. The folder 340 is preferably made of thermal resistant resin such as a liquid crystal plastic (LCP) having a low thermal conductivity, which leads to reduction in heat transfer to the folder 340 and efficient heating of the fixing belt 310.

The folder 340 has a shape that supports two places near each end portion of the base 350 in the transverse direction, thereby avoiding contact with a high-temperature portion of the base 350. With this configuration, the amount of heat flowing to the folder 340 can be further reduced to efficiently heat the fixing belt 310.

The resistance heating elements 361 to 368 and the power lines 360*a* and 360*b* are covered by a thin insulating layer 370. The insulating layer 370 may be made of thermal resistant glass having a thickness of, for example, 75 μm. The insulating layer 370 insulates and protects the resistance heating elements 361 to 368 and the power lines 360*a* and 360*b*, and maintains slidability relative to the fixing belt 310 as described later.

The base 350 is preferably made of aluminum or stainless steel at low cost. The base 350 is not limited to metallic material but may be made of ceramic such as alumina or aluminum nitride, or non-metallic material such as glass or mica, which is excellent in thermal resistance and insulation. The base 350 may be made of material such as copper, graphite, or graphene having a high thermal conductivity to improve the thermal uniformity of the heating device 3000 and increase image quality. In the present embodiment, an alumina base having a short width of 8 mm, a longitudinal width of 270 mm, and a thickness of 1.0 mm is used.

The resistance heating elements 361 to 368 can be formed by applying paste prepared by mixing silver palladium (AgPd), glass powder, and the like on the base 350 by, for example, screen printing, and thereafter, baking the base 350. In the present embodiment, the resistance values of the resistance heating elements 361 to 368 are set to be 80Ω at room temperature.

The resistance heating elements 361 to 368 may be made of a resistance material of silver alloy (AgPt) or ruthenium oxide ($RuO_2$) instead of the above-described materials. The power lines 360*a* and 360*b* and the electrodes 360*c* and 360*d* can be formed of silver (Ag) or silver palladium (AgPd) by, for example, screen printing.

The insulating layer 370 sides of the resistance heating elements 361 to 368 contact with the fixing belt 310 and heat to increase the temperature of the fixing belt 310 through heat transfer, thereby fixing unfixed images conveyed to the fixing nip SN by heating.

As illustrated in FIG. 3A, the resistance heating elements 361 to 368 are divided into eight parts in the longitudinal direction and electrically connected in parallel with each other. The resistance heating elements 361 to 368 may be formed in a fold-back meandering firing pattern to obtain a desired output (resistance value). In the example illustrated in FIG. 3A, the resistance heating elements 361 to 368 are constituted by a meandering pattern of one reciprocation and a half in which a narrow wire is folded back twice.

The base 350 and the resistance heating elements 361 to 368 can heat the fixing nip SN not only through the resistance heating elements 361 to 368 but also through the base 350 by adjusting the respective materials and thermal conductivity. Therefore, as a material of the base 350, a material having high thermal conductivity such as aluminum nitride is preferable.

A gap is formed between adjacent ones of the resistance heating elements 361 to 368 to ensure insulation. If the gap is too large, fixing unevenness would occur due to a decrease in the amount of heat generated in the gap. By contrast, if the gap is too small, insulation might not be achieved, thus causing a short circuit between the resistance heating elements 361 to 368.

Therefore, the size of the gap is preferably from 0.3 mm to 1 mm, and more preferably from 0.4 mm to 0.7 mm. As described above, heating the fixing nip SN via the base 350 can reduce fixing unevenness due to the gap between the resistance heating elements 361 to 368.

As illustrated in FIG. 3A, the resistance heating elements 361 to 368 may be made of a material having a positive temperature resistance coefficient (PTC) characteristic. The material having the PTC characteristic has a characteristic that the resistance value increases (the current I decreases and the heater output decreases) as the temperature T increases. The temperature coefficient of resistance (TCR) may be, for example, 1500 parts per million (PPM). The temperature coefficient of resistance can be stored in the memory of the controller 400.

According to this characteristic, for example, when a sheet narrower than the total width of the resistance heating elements 361 to 368 (for example, narrower than the width of the resistance heating elements 363 to 366) is printed, heat does not transfer to the sheet from the resistance heating elements 361, 362, 367, and 368 outside the width of the sheet, and thus the temperatures of the resistance heating elements increase. Accordingly, the resistance values of the resistance heating elements 361, 362, 367, and 368 increase.

Constant voltage is applied to the resistance heating elements 361 to 368, and thus the outputs of the resistance heating elements 361, 362, 367, and 368 outside the width of the sheet decrease, which leads to reduction in temperature increase at end portions. When the resistance heating elements 361 to 368 are electrically connected in series with each other, there is no method other than lowering the printing speed to reduce temperature increase in a resistance heating element outside the sheet width in continuous printing. Since the resistance heating elements 361 to 368 are electrically connected in parallel with each other, it is possible to reduce temperature increase in a non-sheet passing portion while maintaining the printing speed.

Figure 3B:
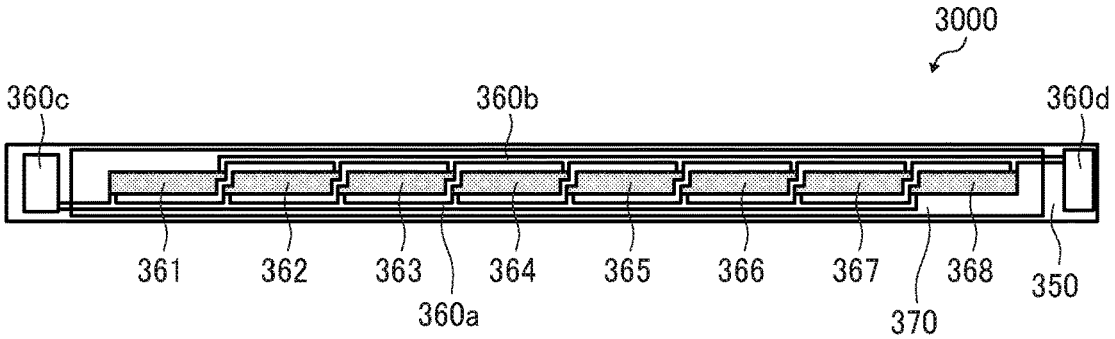
Figure 3C:
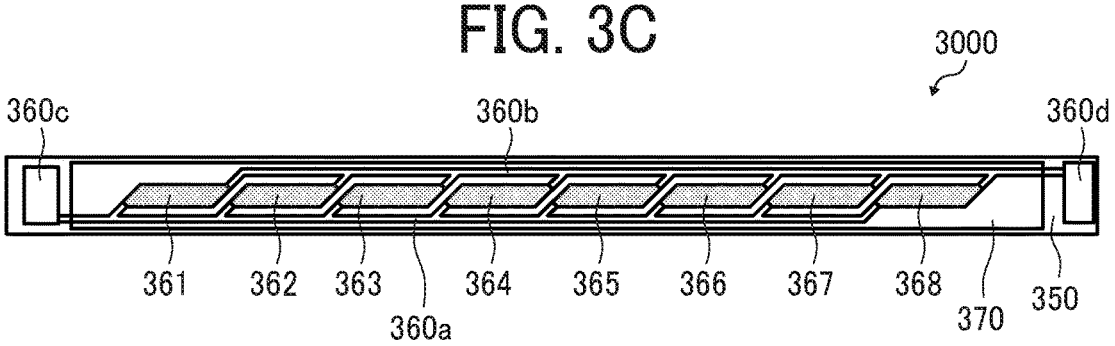

The arrangement of the resistance heating elements 361 to 368 is not limited to the state in illustrated FIG. 3A. In FIG. 3A, a gap extends in the transverse direction between the resistance heating elements 361 to 368. In FIGS. 3B and 3C, the end portions of the resistance heating elements 361 to 368 overlap with each other in the longitudinal direction.

In FIG. 3B, a stepped part is formed at each end portion of the resistance heating elements 361 to 368 by providing an L-shaped cutout and overlaps with the stepped part of an end portion of an adjacent resistance heating element. In FIG. 3C, a tilted part is formed at each end portion of the resistance heating elements 361 to 368 by providing an oblique cutout, and overlaps with the tilted part of an end portion of an adjacent resistance heating element. When the end portions of the resistance heating elements 361 to 368 overlap with each other in this manner, influence due to decrease in the amount of heat generation can be reduced at each gap between the resistance heating elements.

Figure 3D:
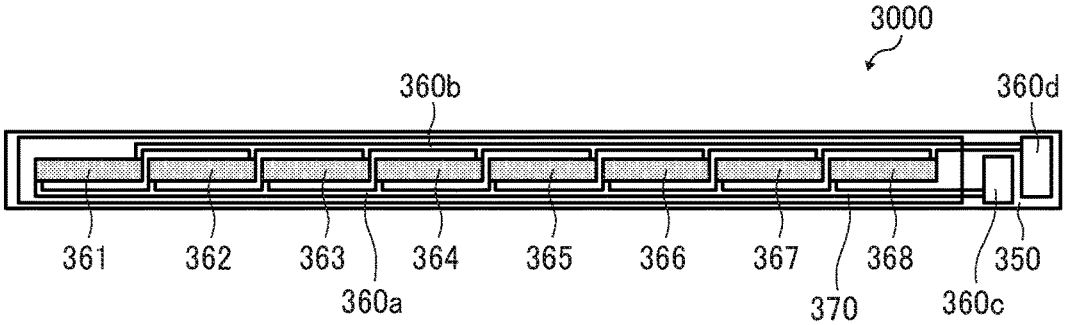
FIGS. 3D to 3F are each a plan view illustrating an array state of resistance heating elements in a planar heat generation body provided with an electrode at one end.
Figure 3E:
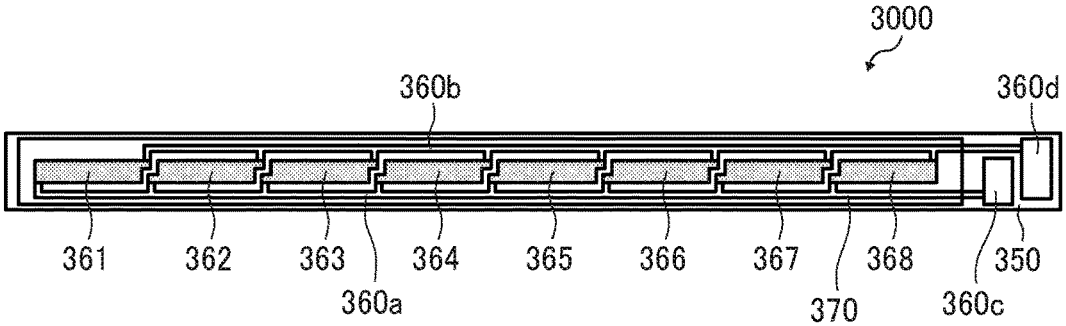
Figure 3F:
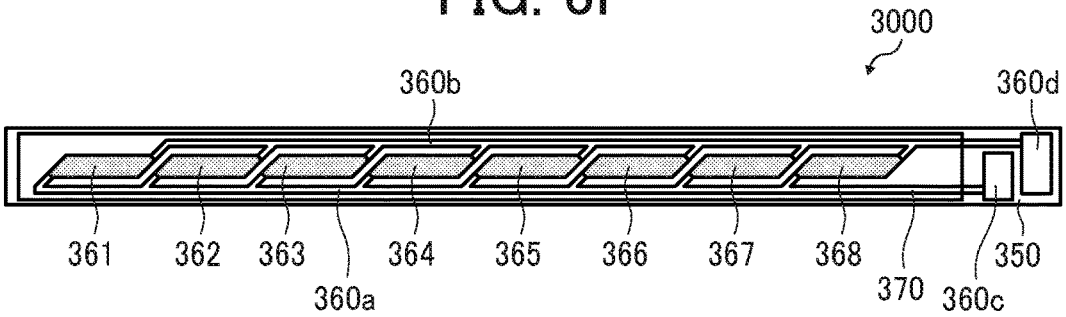

Instead of being disposed at both ends of the resistance heating elements 361 to 368, the electrodes 360*c* and 360*d* may be disposed on one side of the resistance heating elements 361 to 368 as illustrated in FIGS. 3D to 3F. When the electrodes 360*c* and 360*d* are disposed on one side in this manner, space saving can be achieved in the longitudinal direction.

Fixing Operation

In FIG. 2A, when a sheet P is fed toward the fixing nip SN in an arrow direction, the sheet P is heated between the fixing belt 310 and the pressing roller 320 to fix toner images onto the sheet P. In this case, the fixing belt 310 is heated by heat from the heating member 360 while sliding relative to the insulating layer 370 of the heating member 360.

In temperature control by the heating member 360 to adjust the fixing belt 310 to a predetermined temperature, when only the first temperature sensor TH1 is disposed and only the resistance heating element 364 on which the first temperature sensor TH1 is disposed is partially broken to cause cutoff of electrical power supply, the temperature of the resistance heating element 364 does not increase. This situation is the same even when the first temperature sensor TH1 and the second temperature sensor TH2 are disposed in the heating region of an identical resistance heating element. Thus, electrical power supply more than needed continues to the other normal resistance heating elements 361 to 363 and 365 to 368 to adjust the resistance heating element 364 to a certain temperature (first predetermined temperature) by temperature control, which leads to an anomalous high temperature at the resistance heating elements 361 to 363 and 365 to 368.

Hence, in the present embodiment, the first temperature sensor TH1 and the second temperature sensor TH2 are disposed in the heating regions of the different resistance heating elements 364 and 368. Accordingly, even when only the resistance heating element 364 on which the first temperature sensor TH1 is disposed is partially broken to cause cutoff of electrical power supply, the second temperature sensor TH2 can sense an anomalous high temperature of the normal resistance heating element 368 as a second predetermined temperature, which is a predetermined temperature higher than the first predetermined temperature, to securely cut off electrical power supply. The second predetermined temperature is, for example, a temperature determined in advance by experiments and so on, that is, a threshold temperature that might cause a failure if the temperature of the resistance heating element 368 exceeds the threshold temperature.

In particular, since the resistance heating element 368 is disposed at an endmost portion in the longitudinal direction of the base 350, the second predetermined temperature is likely to be sensed early due to influence of temperature increase at the end portion. Thus, electrical power supply can be more securely cut off than when the second temperature sensor TH2 is disposed on a resistance heating element at a position other than an endmost portion in the longitudinal direction. The second temperature sensor TH2 may sense a predetermined lower temperature (breaking) of the resistance heating element 368 than the first predetermined temperature to cut off electrical power supply. In such a configuration, the predetermined lower temperature to be sensed is a temperature determined in advance by experiments and so on, that is, a threshold temperature that might cause a failure if the temperature of the resistance heating element 368 becomes lower than the threshold temperature.

Other Embodiments of Fixing Device

The fixing device 300 is not limited to the first fixing device illustrated in FIG. 2A. The following describes second to fourth fixing devices with reference to FIGS. 2B to 2D. The second fixing device includes a pressure roller 390 on a side opposite to the pressing roller 320 as illustrated in FIG. 2B to heat the fixing belt 310 between the pressure roller 390 and the heating device 3000.

The above-described heating device 3000 is disposed inside the fixing belt 310. The stay 330 has one side attached to an auxiliary stay 331 and the other side attached to a nip formation pad 332. The heating device 3000 is held by the auxiliary stay 331. The nip formation pad 332 is in contact with the pressing roller 320 through the fixing belt 310 to form the fixing nip SN.

In the third fixing device, the heating device 3000 is disposed inside the fixing belt 310 as illustrated in FIG. 2C. In the heating device 3000, the pressure roller 390 is omitted, and the base 350 and the insulating layer 370 are formed to have arc cross-sections in accordance with the curvature of the fixing belt 310 to increase the length of contact with the fixing belt 310 in the circumferential direction. The heating member 360 is disposed at the center of the arc-shaped base 350. The other configuration is the same as the configuration of the second fixing device illustrated in FIG. 2B.

In the fourth fixing device, a heating nip HN is provided separately from the fixing nip SN as illustrated in FIG. 2D. Specifically, the nip formation pad 332 and a stay 333 made of a metal channel material are disposed on a side of the pressing roller 320 opposite to the fixing belt 310, and a pressing belt 334 is rotatably disposed to enclose the nip formation pad 332 and the stay 333. A sheet P is fed to the fixing nip SN between the pressing belt 334 and the pressing roller 320 and fixed by heating. The other configuration is the same as the configuration of the first fixing device illustrated in FIG. 2A.

As illustrated with a dashed line in FIG. 2A, the second temperature sensor TH2 for securing safety may be bonded, by pressing through a pressing unit, on the inner peripheral surface of the fixing belt 310 (at a position downstream from the resistance heating element 368 in the conveyance direction of the sheet P) heated by the resistance heating element 368 different from the resistance heating element 366 at which sensing is performed by the first temperature sensor TH1 for temperature control. When the number of resistance heating elements is increased, it becomes difficult to allocate a space in which temperature sensors are disposed. However, the space allocation difficulty can be reduced when the second temperature sensor TH2 is disposed as described above. The second temperature sensor TH2 for securing safety may be disposed not only on the resistance heating element 368 but also in each region of the other resistance heating elements 361 to 363 and 365 to 367 including the inner peripheral surface of the fixing belt 310.

Flowchart

Figure 5:
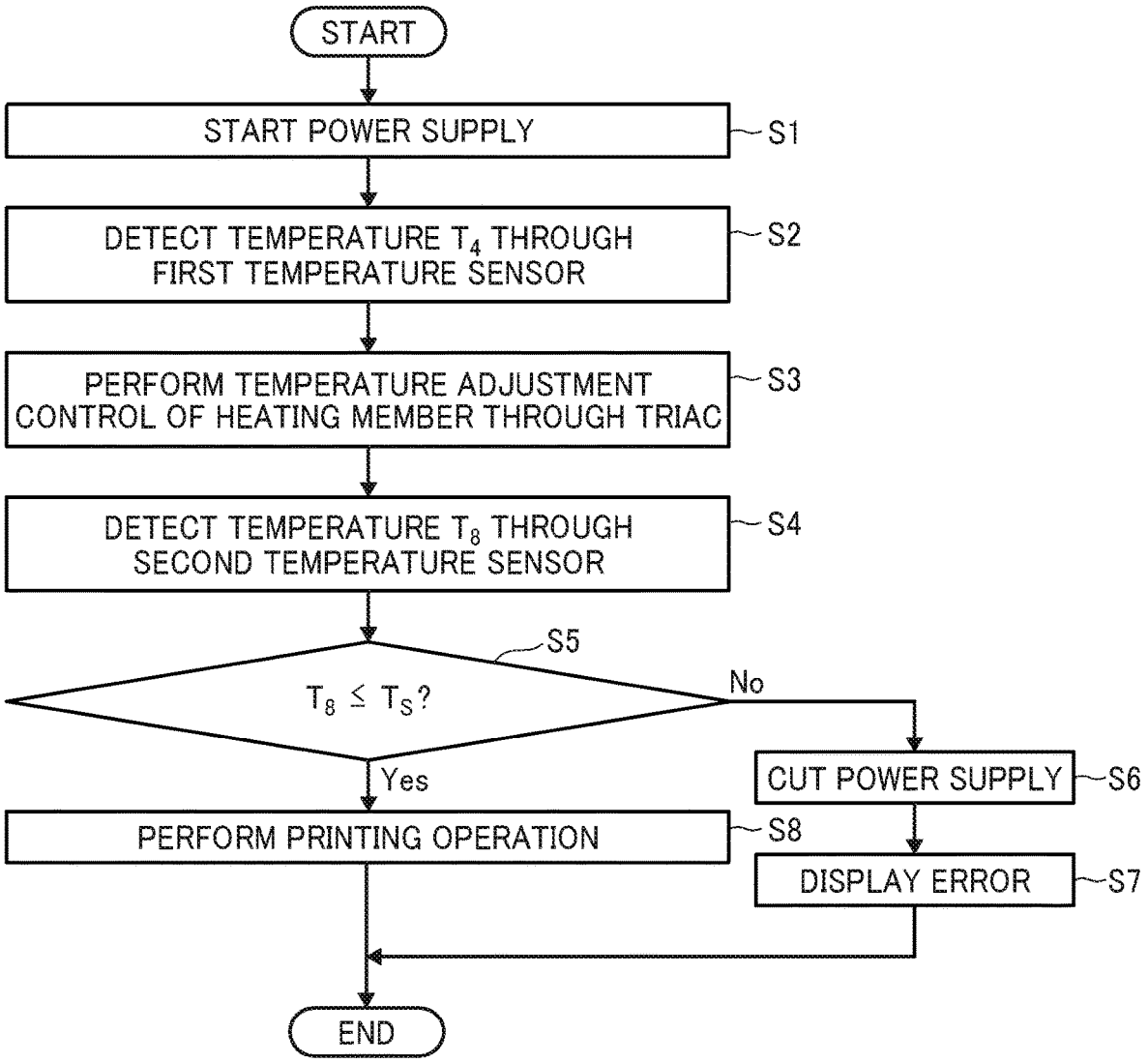
FIG. 5 is a flowchart illustrating a control operation of the heating device.

FIG. 5 is a flowchart illustrating a control operation of the heating device 3000 executed by the controller 400 described above. When execution of a printing job is instructed to the color laser printer 100, at step S1 the controller 400 causes the alternating-current power source 410 to start power supply to the resistance heating elements 361 to 368 of the heating member 360. Then, at step S2, the first temperature sensor TH1 senses the temperature $T_4$ of the resistance heating element 364 positioned in the central region of the heating member 360.

Subsequently at step S3, temperature adjustment control of the heating member 360 is started. At step S4, the second temperature sensor senses the temperature $T_8$ of the resistance heating element 368. Then, at step S5, the controller 400 determines whether the temperature $T_8$ is equal to or lower than $T_s$ ($T_s$: safety upper limit temperature). When $T_s$ is lower than $T_8$ (No at step S5), the occurrence of anomalous temperature is detected and at step S6 the electrical power supply to the heating member 360 is cut off, and at step S7 an error is displayed on an operation panel of the color laser printer 100. When $T_8$ is equal to or lower than $T_s$ (Yes at step S5), no occurrence of anomalous temperature is detected, and a printing operation is started at step S8.

With a configuration in which a plurality of resistance heating elements is connected in parallel with each other, even when any one of the resistance heating elements is broken, current continuously flows through the other resistance heating elements. When a temperature sensor such as a thermistor is disposed in the heating region of each resistance heating element, the temperatures of the resistance heating elements can be individually controlled to prevent anomalous temperature increase in any resistance heating element.

However, if temperature sensors are attached to all the resistance heating elements, the cost would increase. However, for example, when a temperature sensor is only attached to one resistance heating element at the center in the longitudinal direction, breaking of the resistance heating element potentially might lead to continuous current increase at the other resistance heating elements and loss of temperature control.

Hence, embodiments of the present disclosure provide a heating device, a fixing device, and an image forming apparatus each capable of preventing anomalous temperature increase in a plurality of resistance heating elements of a planar heating body by controlling the temperatures of the resistance heating elements by using temperature sensors in a number as small as possible.

According to at least one embodiment of the present disclosure, even when a first resistance heating element is broken to lose temperature control of a plurality of resistance heating elements by a first temperature sensor, sensing of a second predetermined temperature is performed by a second temperature sensor to cut off electrical power supply to each resistance heating element, thereby preventing anomalous temperature increase in the resistance heating element.

Although the present disclosure has been described based on some embodiments, embodiments of the present disclosure is not limited to the above-described embodiments, and various modifications are possible within the scope of the technical idea described in the claims. For example, the heating device according to an embodiment of the present disclosure is applicable to usage such as a drying device other than a fixing device. The overlapping of resistance heating elements may have a configuration such as mutual engagement of concave-convex shapes or comb teeth shapes, other than the configurations illustrated in FIGS. 3B, 3C, 3E, and 3F. The number of resistance heating elements may be less than eight or may be nine or more. Moreover, resistance heating elements may be disposed in a plurality of columns in the transverse direction of the base 350.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a base;

a plurality of resistance heating elements disposed in a longitudinal direction of the base and electrically connected in parallel with each other;

a power control circuit configured to supply electrical power to the plurality of resistance heating elements;

a first temperature sensor configured to sense a temperature of a first resistance heating element of the plurality of resistance heating elements;

a second temperature sensor overlapping only a second resistance heating element of the plurality of resistance heating elements and not overlapping any other of the plurality of resistance heating elements such that the second temperature sensor is configured to sense a temperature of the second resistance heating element, the second temperature sensor being a same kind of temperature sensor as the first temperature sensor; and a controller configured to, supply an electrical power amount of the power control circuit so that temperatures of all of the plurality of resistance heating elements are heated to a first predetermined temperature based on a result of sensing with the first temperature sensor, and cut off the electrical power supplied from the power control circuit to all of the plurality of resistance heating elements in response to sensing, via the second temperature sensor, that the second resistance heating element has reached a second predetermined temperature prior to sensing, via the first temperature sensor, that the first resistance heating element has reached the first predetermined temperature.

2. The image forming apparatus according to claim 1, wherein the first temperature sensor is positioned directly over a single one of the plurality of resistance heating elements.

3. The image forming apparatus according to claim 1, wherein the second temperature sensor is disposed in an end region of the base in the longitudinal direction.

4. The image forming apparatus according to claim 1, wherein the plurality of resistance heating elements is made of a resistance material having a positive resistance temperature characteristic.

5. The image forming apparatus according to claim 1, wherein at least a portion of adjacent ones of the plurality of resistance heating elements overlap with each other in the longitudinal direction of the base.

6. The image forming apparatus according to claim 1, further comprising:

a fixing device including:

a pressing rotator;

a nip former configured to form a fixing nip between the nip former and the pressing rotator to fix a developer on a recording medium passing through the fixing nip; and a belt member having a tubular shape.

7. The image forming apparatus according to claim 6, wherein the plurality of resistance heating elements is disposed at an inner side of the belt member, wherein the belt member is to rotate around the plurality of resistance heating elements while being nipped with the nip former and the pressing rotator in the fixing nip.

8. The image forming apparatus according to claim 6, wherein the heat of the belt member is transferred to the fixing nip via the pressing rotator.

9. The image forming apparatus according to claim 6, further comprising:

an image forming device configured to form the image with the developer; and a recording-medium feeder configured to feed the recording medium to the image forming device wherein, the fixing device is configured to fix the image on the recording medium.

10. The image forming apparatus according to claim 1, wherein each of the first temperature sensor and the second temperature sensor is a thermistor.

11. The image forming apparatus according to claim 1, wherein the plurality of resistance heating elements are divided into eight parts.

12. The image forming apparatus according to claim 1, wherein the plurality of resistance heating elements are formed in a fold- back meandering heating pattern.

13. The image forming apparatus according to claim 1, wherein the base is made of aluminum nitride.

14. The image forming apparatus according to claim 1, wherein the controller is configured to control the power control circuit to heat all of the plurality of resistances heating elements.

15. An image forming apparatus comprising:

a base;

a plurality of resistance heating elements disposed in a longitudinal direction of the base and electrically connected in parallel with each other;

a power controller configured to supply electrical power to the plurality of resistance heating elements;

a first temperature sensor configured to sense a temperature of a first resistance heating element of the plurality of resistance heating elements;

a second temperature sensor overlapping only a second resistance heating element of the plurality of resistance heating elements and not overlapping any other of the plurality of resistance heating elements such that the second temperature sensor is configured to sense a temperature of the second resistance heating element; and a controller configured to, control supply of the electrical power from the power controller so that temperatures of all of the plurality of resistance heating elements are heated to a first predetermined temperature based on a result of sensing with the first temperature sensor, and cut off the electrical power supplied from the power controller to all of the plurality of resistance heating elements in response to sensing, via the second temperature sensor, that the second resistance heating element has reached a second predetermined temperature.

16. An image forming apparatus comprising:

a base;

a plurality of resistance heating elements disposed in a longitudinal direction of the base and electrically connected in parallel with each other;

a first temperature sensor configured to sense a temperature of a first resistance heating element of the plurality of resistance heating elements;

a second temperature sensor overlapping only a second resistance heating element of the plurality of resistance heating elements and not overlapping any other of the plurality of resistance heating elements such that the second temperature sensor is configured to sense a temperature of the second resistance heating element; and a first elastic member configured to generate pressure to press the first temperature sensor to the base, wherein temperatures of all of the plurality of resistance heating elements are heated to a first predetermined temperature based on a result of sensing with the first temperature sensor, and electrical power supplied to all of the plurality of resistance heating elements is cut off in response to sensing, via the second temperature sensor, that the second resistance heating element has reached a second predetermined temperature.

17. The image forming apparatus of claim 16, further comprising:

a second elastic member configured to generate pressure to press the second temperature sensor to the base.

18. An image forming apparatus comprising:

a base;

a plurality of resistance heating elements disposed in a longitudinal direction of the base and electrically connected in parallel with each other;

a power control circuit configured to supply electrical power to the plurality of resistance heating elements;

a plurality of electric temperature sensors including at least a first temperature sensor opposite a first resistance heating element of the plurality of resistance heating elements and a second temperature sensor opposite a second resistance heating element of the plurality of resistance heating elements such that only two of the plurality of electric temperature sensors are disposed opposite respective ones of two of the plurality of resistance heating elements electrically connected in parallel; and a controller configured to, supply the electrical power from the power control circuit to all of the plurality of resistance heating elements so that a temperature detected by the first temperature sensor approaches a first predetermined temperature, and cut off the electrical power supplied from the power control circuit to all of the plurality of resistance heating elements in response to a temperature detected by the second temperature sensor reaching a second predetermined temperature prior to the temperature detected by the first temperature sensor reaching the first predetermined temperature.

19. The image forming apparatus according to claim 18, wherein the first temperature sensor is positioned directly over a single one of the plurality of resistance heating elements.

20. The image forming apparatus according to claim 18, wherein the second temperature sensor is disposed in an end region of the base in the longitudinal direction.

21. The image forming apparatus according to claim 18, wherein the plurality of resistance heating elements is made of a resistance material having a positive resistance temperature characteristic.

22. The image forming apparatus according to claim 18, wherein at least a portion of adjacent ones of the plurality of resistance heating elements overlap with each other in the longitudinal direction of the base.

23. The image forming apparatus according to claim 18, further comprising:

a fixing device including:

a pressing rotator;

a nip former configured to form a fixing nip between the nip former and the pressing rotator to fix a developer on a recording medium passing through the fixing nip; and a belt member having a tubular shape.

24. The image forming apparatus according to claim 23, wherein the plurality of resistance heating elements is disposed at an inner side of the belt member, wherein the belt member is to rotate around the plurality of resistance heating elements while being nipped with the nip former and the pressing rotator in the fixing nip.

25. The image forming apparatus according to claim 23, wherein the heat of the belt member is transferred to the fixing nip via the pressing rotator.

26. The image forming apparatus according to claim 23, further comprising:

an image forming device configured to form the image with the developer; and a recording-medium feeder configured to feed the recording medium to the image forming device wherein, the fixing device is configured to fix the image on the recording medium.

27. The image forming apparatus according to claim 18, wherein each of the first temperature sensor and the second temperature sensor is a thermistor.

28. The image forming apparatus according to claim 18, wherein the plurality of resistance heating elements is divided into eight parts.

29. The image forming apparatus according to claim 18, wherein the plurality of resistance heating elements is formed in a fold-back meandering heating pattern.

30. The image forming apparatus according to claim 18, wherein the base is made of aluminum nitride.

31. The image forming apparatus according to claim 18, wherein the controller is configured to control the power control circuit to heat all of the plurality of resistances heating elements.

32. The image forming apparatus of claim 18, wherein only the first temperature sensor and the second temperature sensor are opposite ones of the plurality of resistance heating elements on the base such that no other ones of the plurality of electric temperature sensors are opposite any other of the plurality of resistance heating elements on the base.

33. An image forming apparatus comprising:

a base;

a plurality of resistance heating elements disposed in a longitudinal direction of the base and electrically connected in parallel with each other;

a power controller configured to supply electrical power to the plurality of resistance heating elements;

a plurality of electric temperature sensors including at least a first temperature sensor opposite a first resistance heating element of the plurality of resistance heating elements and a second temperature sensor opposite a second resistance heating element of the plurality of resistance heating elements such that only two of the plurality of electric temperature sensors are disposed opposite respective ones of two of the plurality of resistance heating elements electrically connected in parallel; and a controller configured to, supply the electrical power from the power controller to all of the plurality of resistance heating elements so that a temperature detected by the first temperature sensor approaches a first predetermined temperature, and cut off the electrical power supplied from the power controller to all of the plurality of resistance heating elements in response to a temperature detected by the second temperature sensor reaching a second predetermined temperature.

34. The image forming apparatus of claim 33, wherein the second temperature sensor is only opposite the second resistance heating element.

35. The image forming apparatus of claim 33, wherein the second temperature sensor is a same kind of temperature sensor as the first temperature sensor.

36. An image forming apparatus comprising:

a base;

a plurality of resistance heating elements disposed in a longitudinal direction of the base and electrically connected in parallel with each other;

a plurality of electric temperature sensors including at least a first temperature sensor opposite a first resistance heating element of the plurality of resistance heating elements and a second temperature sensor opposite a second resistance heating element of the plurality of resistance heating elements such that only two of the plurality of electric temperature sensors are disposed opposite respective ones of two of the plurality of resistance heating elements electrically connected in parallel; and a first elastic member configured to generate pressure to press the first temperature sensor to the base, wherein electrical power is supplied to all of the plurality of resistance heating elements so that a temperature of the first resistance heating element is heated to approach a first predetermined temperature, and the electrical power supplied to all of the plurality of resistance heating elements is cut off in response to a temperature detected by the second temperature sensor reaching a second predetermined temperature.

37. The image forming apparatus of claim 36, further comprising:

a second elastic member configured to generate pressure to press the second temperature sensor to the base.

38. The image forming apparatus of claim 36, wherein the second temperature sensor is only opposite the second resistance heating element.

* * * * *